US008505777B2

(12) United States Patent
Romanyszyn et al.

(10) Patent No.: US 8,505,777 B2
(45) Date of Patent: Aug. 13, 2013

(54) METHOD AND APPARATUS FOR A SANITIZABLE MIXING NOZZLE

(75) Inventors: Michael T. Romanyszyn, San Antonio, TX (US); Basil Girjis, San Antonio, TX (US); Donald W. Smeller, Converse, TX (US)

(73) Assignee: Lancer Corporation, San Antonio, TX (US)

( * ) Notice: Subject to any disclaimer, the term of this patent is extended or adjusted under 35 U.S.C. 154(b) by 355 days.

(21) Appl. No.: 12/806,545

(22) Filed: Aug. 16, 2010

(65) Prior Publication Data

US 2012/0037662 A1 Feb. 16, 2012

(51) Int. Cl.
*B67D 7/78* (2010.01)

(52) U.S. Cl.
USPC ..... 222/145.6; 222/129.1; 222/145.2; 222/145.5

(58) Field of Classification Search
USPC ..... 222/129.1, 145.2, 145.5, 145.6
See application file for complete search history.

(56) References Cited

U.S. PATENT DOCUMENTS

| | | | | |
|---|---|---|---|---|
| 4,218,014 | A * | 8/1980 | Tracy | 239/106 |
| 4,986,447 | A * | 1/1991 | McCann et al. | 222/129.1 |
| 5,048,726 | A * | 9/1991 | McCann et al. | 222/129.1 |
| 5,203,474 | A * | 4/1993 | Haynes | 222/129.1 |
| 5,992,685 | A * | 11/1999 | Credle, Jr. | 222/1 |
| 6,401,981 | B1 * | 6/2002 | McCann et al. | 222/129.1 |
| 7,168,593 | B2 | 1/2007 | Schroeder et al. | |
| 2006/0237479 | A1 * | 10/2006 | Fox | 222/129.1 |

* cited by examiner

*Primary Examiner* — Kevin P Shaver
*Assistant Examiner* — Donnell Long
(74) *Attorney, Agent, or Firm* — Christopher L. Makay

(57) ABSTRACT

A mixer assembly includes a mixer body and a mixer cover coupled to the mixer body. The mixer body includes an inner wall defining a mixing chamber having an inlet and an outlet. The inner wall includes a plurality of protrusions disposed on top of the inner wall that form a plurality of passes therebetween. The mixer body further includes a shell disposed around the inner wall that forms a diluent chamber between the inner wall and the shell. Diluent entering the diluent chamber flows through the plurality of passes and into the mixing chamber for mixing with product entering from the inlet of the mixing chamber. Mixed product exits the mixer body from the outlet of the mixing chamber. The mixer cover includes an angled shelf that closes out the diluent chamber and extends over the plurality of passes such that diluent entering the diluent chamber moves through the plurality of passes along the angled shelf and into the mixing chamber.

14 Claims, 9 Drawing Sheets

METHOD AND APPARATUS FOR A SANITIZABLE MIXING NOZZLE

BACKGROUND OF THE INVENTION

1. Field of the Invention

The present invention relates to product dispensing equipment and, more particularly, but not by way of limitation, to methods and an apparatus for a sanitizable mixing nozzle in a product dispenser.

2. Description of the Related Art

In the product dispensing industry, it is often desirable to dehydrate products to reduce transport costs. Food product manufacturers routinely prepare high concentration products that may be reconstituted on demand through the use of a product dispenser. However, the multitude of products and product varieties available from today's food manufacturers creates issues with both the product and the product dispensers.

On the product side of the problem, the multitude of product varieties requires multiple solutions, because products, dependent upon their consistency, act differently when being reconstituted. In particular, thick products or products having low quantities of water go from flowable to almost stagnant during the dehydration process, and, therefore, the dehydrated product must be acted upon to move the product. Still further, usage temperatures, storage temperatures, and the like, provide further variability between the products.

On the product dispenser side of the problem, products with limited life or having spoilage issues often require refrigeration, thereby creating interface issues between the refrigerated compartment and the ambient environment. Often, an easily reconstituted product package including a tube is placed into a storage chamber, the tube is engaged by a pumping device disposed within the confines of the product dispenser, and product from the product package is delivered to a mixing nozzle that protrudes from the product dispenser to deliver a reconstituted product.

Problems arise when the product package provides enough product for extended use. Illustratively, a product package including enough product for a hundred reconstituted drinks may remain in the product dispenser for days because of low usage resulting in spoilage of the product. Moreover, the problem is compounded when the mixing nozzle retains reconstituted product for extended periods. This exposes the reconstituted product to the ambient environment, thereby providing bacteria disposed on the mixing nozzle ample time to multiply.

An attempt to rectify this problem includes product packages formed with a disposable mixing nozzle. Unfortunately, the increased component cost associated with the distribution of product packages including disposable mixing nozzle makes such distribution less than desirable. Moreover, while disposable mixing nozzles are supposed to eliminate clean up, this is often not the case, and the disposable mixing nozzles must be cleaned anyway, which is problematic as disposable mixing nozzles are typically constructed from injection molded components not easily separable.

Accordingly, a product dispenser with a sanitizable mixer assembly reduces the cost of the product package, and ensures a sanitary environment at the mixer assembly.

SUMMARY OF THE INVENTION

In accordance with the present invention, a mixer assembly includes a mixer body and a mixer cover coupled to the mixer body. The mixer body includes an inner wall defining a mixing chamber having an inlet and an outlet. The inner wall includes a plurality of protrusions disposed on top of the inner wall that form a plurality of passes therebetween. The mixer body further includes a shell disposed around the inner wall that forms a diluent chamber between the inner wall and the shell. Diluent entering the diluent chamber flows through the plurality of passes and into the mixing chamber for mixing with product entering from the inlet of the mixing chamber. Mixed product exits the mixer body from the outlet of the mixing chamber. The mixing chamber includes a deflector disposed therein such that diluent moving through the plurality of passes contacts the deflector which forces a change in direction of the diluent and the product entering the mixing chamber to increase the interaction between the product and the diluent.

The mixer body still further includes a drain relief disposed in the outlet of the mixing chamber. The drain relief forces the mixer body to fully drain, and, in this preferred embodiment, the drain relief is a slot in the outlet of the mixing chamber that prevents a symmetrical fluid meniscus from forming. The mixer body even further includes a flow director disposed in the outlet of the mixing chamber for streamlining erratic flow delivery of mixed product.

The mixer cover includes a shelf angled toward the outlet of the mixing chamber. The angled shelf closes out the diluent chamber and extends over the plurality of passes such that diluent entering the diluent chamber moves through the plurality of passes along the angled shelf and into the mixing chamber at an increased velocity. The diluent moving through the plurality of passes moves along the angled shelf and continues toward a center of the mixing chamber. Moreover, the diluent passing through the plurality of passes inherits the angle of the angled shelf, thereby engaging the product in the mixing chamber at an angle. The mixer cover further includes an outlet port adaptable to the shell of the mixer body. The outlet port is placed over the shell until the angled shelf contacts the plurality of protrusions and the shell, thereby closing out the diluent chamber.

The mixer cover still further includes an inlet port adaptable to a product package. A product outlet of the product package is coupled to the inlet port such that the product moves from the product package into the mixer assembly. The coupling of the product package outlet to the inlet port of the mixer cover eliminates exposure to an ambient environment and eliminates errant splashing as the product moves from the product package to the mixer assembly. The mixer cover is removable from the mixer body for cleansing of both the mixer cover and the mixer body.

It is therefore an object of the present invention to provide a mixer assembly usable with a variety of products and product concentrates.

It is a further object of the present invention to provide a mixer assembly with a mixer cover separable from a mixer body for cleansing of both the mixer cover and the mixer body.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

Figure 1A:
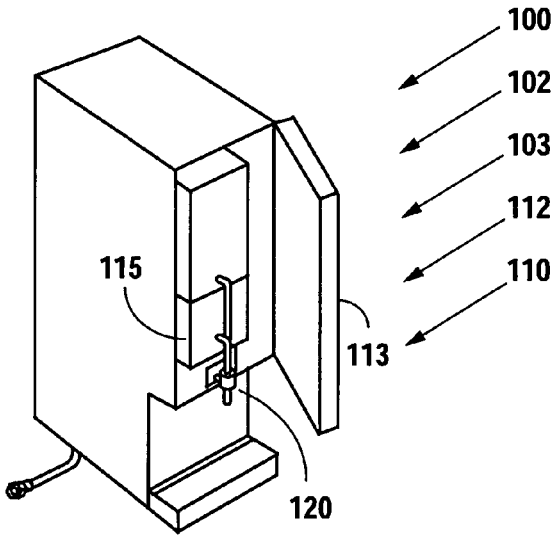
FIG. 1*a* provides a perspective view of a product dispenser according to the preferred embodiment.
Figure 1B:
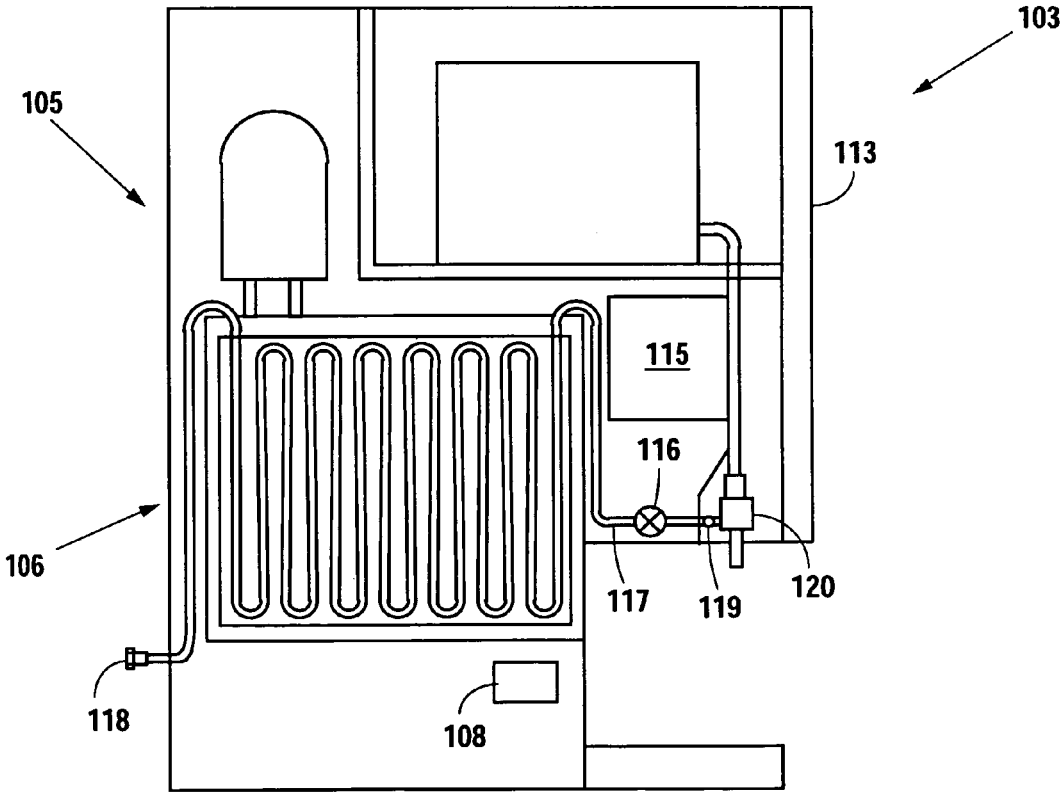
FIG. 1*b* provides a section view of the product dispenser according to the preferred embodiment.
Figure 2A:
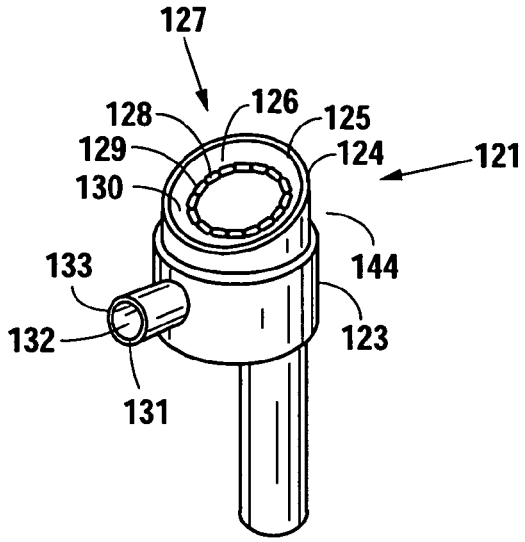
FIG. 2*a* provides a perspective view of a mixer assembly according to the preferred embodiment.
Figure 2B:
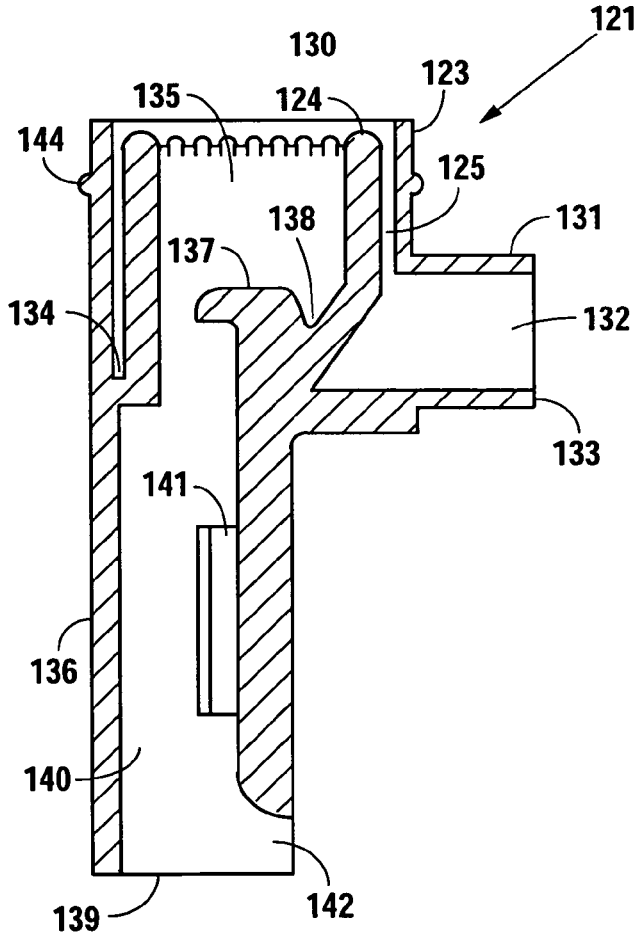
FIG. 2*b* provides a section view of a mixer body according to the preferred embodiment.
Figure 3A:
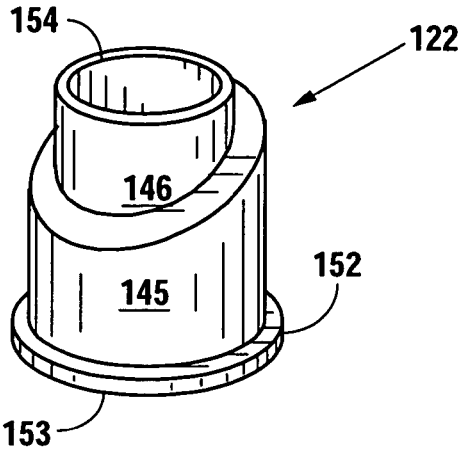
FIG. 3*a* provides a perspective view of a mixer cover according to the preferred embodiment.
Figure 3B:
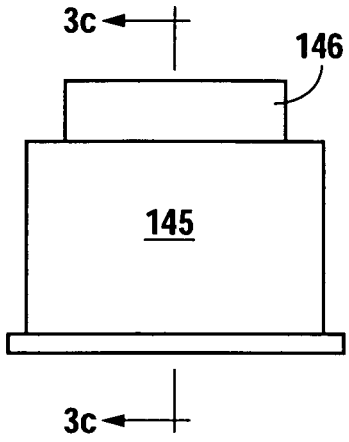
FIG. 3*b* provides a front view of a mixer cover according to the preferred embodiment.
Figure 3C:
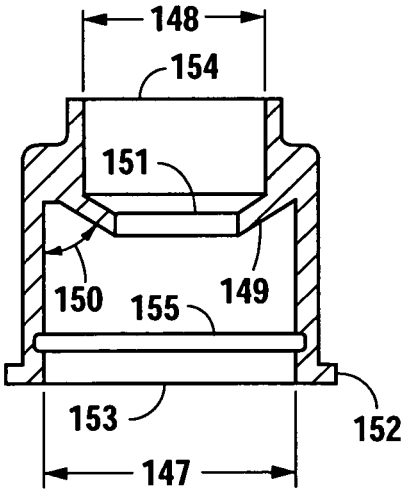
FIG. 3*c* provides a section view of a mixer cover according to the preferred embodiment.

As shown in FIGS. 1*a* and 1*b*, a product dispenser 100 includes a housing 110, at least one product circuit configuration 102, at least one diluent dispensing circuit 103, and a mixer assembly 120. In the present invention, the term product dispenser is defined as a device that delivers a product or a product concentrate for mixing with a diluent at a dispense point. Illustratively, the product dispenser 100 may deliver carbonated beverages, teas, waters, juices, milks, and the like. In this disclosure, the term housing is defined as any type housing known in the art of product dispensing, including refrigerated dispensers, ice cooled dispensers, and ambient dispensers.

In this particular example, the housing 110 includes a chamber 112 for receiving a product package configuration, and a door 113 for closing out the chamber 112. The housing 110 further includes a cold source for chilling. Also in this particular example, the cold source is a refrigeration circuit 105 having coils disposed in an ice-water bath 106. Coils of the diluent circuit 103 are similarly submerged in the ice/water bath 106 to chill a diluent passing through the coils. Within this particular example, the cold source also chills the chamber 112 by passing refrigeration lines through heat exchangers disposed within the chamber 112. While this particular example has been shown with the chamber 112 being cooled by a refrigeration circuit 105 and heat exchangers disposed within the chamber 112, one of ordinary skill in the art will recognize that other forms of chilling are available, including ice-cooled equipment having a cold plate, and the like.

As shown in FIG. 1*b*, the diluent circuit 103 includes a diluent line 117 having an inlet 118 and an outlet 119. The inlet 118 is suitable for connection to a diluent source (not shown) and the outlet 119 is disposed near a front of the product dispenser 100, and connects to the mixer assembly 120. The diluent circuit 103 further includes a valve 116 in electrical communication with a controller 108, wherein the controller 108 delivers open and close signals for the delivery of the diluent through the diluent line 117. Accordingly, the diluent moves from the diluent source, through the coils disposed within the ice/water bath 106, and to the diluent outlet 119 when the valve 116 is in an open position, and the diluent flow ceases at the valve 116 when the valve 116 is in a closed position.

The product dispenser 100 further includes a pumping device 115 disposed in proximity to the door 113, such that the pumping device 115 may be accessed when the door 113 is in an open position. In this particular example, the pumping device 115 is a peristaltic pump that engages a tube connected to a product package. While this particular example is shown as having a peristaltic pump, one of ordinary skill in the art will recognize that virtually any type of pumping device may be utilized to move product from a product source to a product outlet.

As shown in FIGS. 2*a*-4*b*, the mixer assembly 120 includes a mixer body 121 and a mixer cover 122. The mixer body 121 includes a cylindrical shell 123 and an inner wall 124 offset from the cylindrical shell 123, thereby creating a diluent chamber 125 between the cylindrical shell 123 and the inner wall 124. In this particular example, the cylindrical shell 123 includes a ridge 126 creating an upper port 127. The inner wall 124 includes an inner ridge 128, wherein the inner ridge 128 is disposed lower than the ridge 126 of the cylindrical shell 123. The inner ridge 128 includes protrusions 129 disposed at a predetermined height and distance, thereby creating passes 130 between the protrusions 129. In this particular example, the protrusions 129 terminate at a same elevation, and do not extend beyond the ridge 126 of the cylindrical shell 123. The cylindrical shell 123 further includes an interlock feature 144 disposed at a predetermined spacing from the upper port 127. In this particular example, the interlock feature 144 is a protrusion disposed on an outer surface of the cylindrical shell 123. While the shell in this particular example has been shown as being cylindrical, one of ordinary skill in the art will recognize that other shapes are possible.

The mixer body 121 further includes an inlet portion 131 having an inlet passage 132 leading to the diluent chamber 125, and a diluent inlet port 133 in fluid communication with the inlet passage 132. The diluent chamber 125 further includes a floor 134.

The mixer body 121 further includes a mixing chamber 135 disposed within the inner wall 124, and an outlet portion 136 extending from a floor 138 of the mixer body 121. The mixer body 121 still further includes a deflector 137 disposed within the mixing chamber 135. The deflector 137 is a circular protrusion extending from the floor 138 of the mixing chamber 135, and is disposed substantially centrally within the mixing chamber 135. The outlet portion 136 is cylindrical in shape, and includes an outlet port 139 and an outlet passage 140 passing from the mixing chamber 135 to the outlet port 139. The outlet passage 140 includes at least one flow director 141 to help streamline erratic flow delivery. The outlet port 139 includes a drain relief 142 to ensure all fluids drain from the mixer assembly 120. In this particular example, the drain relief 142 is a slot in the outlet port 139, wherein the slot creates an unsymmetrical meniscus, thereby forcing the fluid to drain from the mixer body 121.

The mixer cover 122 includes a first cylindrical section 145 and a second cylindrical section 146 disposed coaxially. The first and second cylindrical sections 145-146 are hollow, and, therefore, include an outlet port 153 and an inlet port 154, respectively. The outlet port 153 includes a first inner diameter 147 that is complementary to an outer diameter 143 of the cylindrical shell 123 of the mixer body 121, and the inlet port 154 includes a second inner diameter 148. In this particular example, the second inner diameter 148 of the second cylindrical section 146 is smaller than the inner diameter 147 of the first cylindrical section 145. The mixer cover 122 further includes an annular shelf 149 disposed within the first cylindrical section 145. The annular shelf 149 is disposed at an angle 150 and extends downward, thereby forming an inner port 151 that passes through the mixer cover 122. The second inner diameter 148 of the inlet port 154 is complementary in size to an outer diameter 163 of a tube 162 extending from a product package 160. The mixer cover 122 further includes a lip 152 extending around the outlet port 153 and a recess 155 extending along the first inner diameter 147 in proximity to the outlet port 153. The recess 155 is complementary in shape to the interlock feature 144 disposed on the mixer body 121. In this particular example, the mixer cover 122 is constructed from sanoprene, and, therefore, is pliable. However, one of ordinary skill in the art will recognize that other food grade materials may be utilized.

On assembly of the mixer assembly 120, the outlet port 153 of the first cylindrical section 145 is pushed over the upper port 127 of the mixer body 121 until the annular shelf 149 contacts the ridge 126 and the inner ridge 128, and the interlock feature 144 moves into the recess 155 of the mixer cover 122. Upon assembly, the diluent chamber 125 is partially closed out by the annular shelf 149 of the mixer cover 122. As such, a diluent flowpath through the mixer assembly 120 moves from the diluent inlet passage 132 into the diluent chamber 125, through the passes 130 disposed between the protrusions 129, and into the mixing chamber 135. The reduced area flow path created by the protrusions 129 and the passes 130 creates increased flow velocities through the passes 130 and into the mixing chamber 135. Once in the mixing chamber 135, the diluent moves into the deflector 137 for increased turbulence and better mixing, and then exits the mixing chamber 135 through the outlet passage 140 and the outlet port 139.

The assembled mixer assembly 120 is installed into the product dispenser 100 by opening the door 113, and inserting the diluent inlet port 133 onto the diluent outlet 119. In this particular configuration, the diluent outlet 119 is a dole connection, and, accordingly, the mixer assembly 120 may be removed and replaced, as desired. One of ordinary skill in the art will recognize that the mixer assembly 120 requires restraint, and the mixer assembly 120 may be restrained by the closed door 113 or any other suitable restraint.

The controller 108 conducts dispensing operations. In this invention, the term controller 108 may be any form of processing device commonly utilized in the industry, and able to conduct component operations of hardware associated with controlling fluid flows, as well as related operations.

Figure 4A:
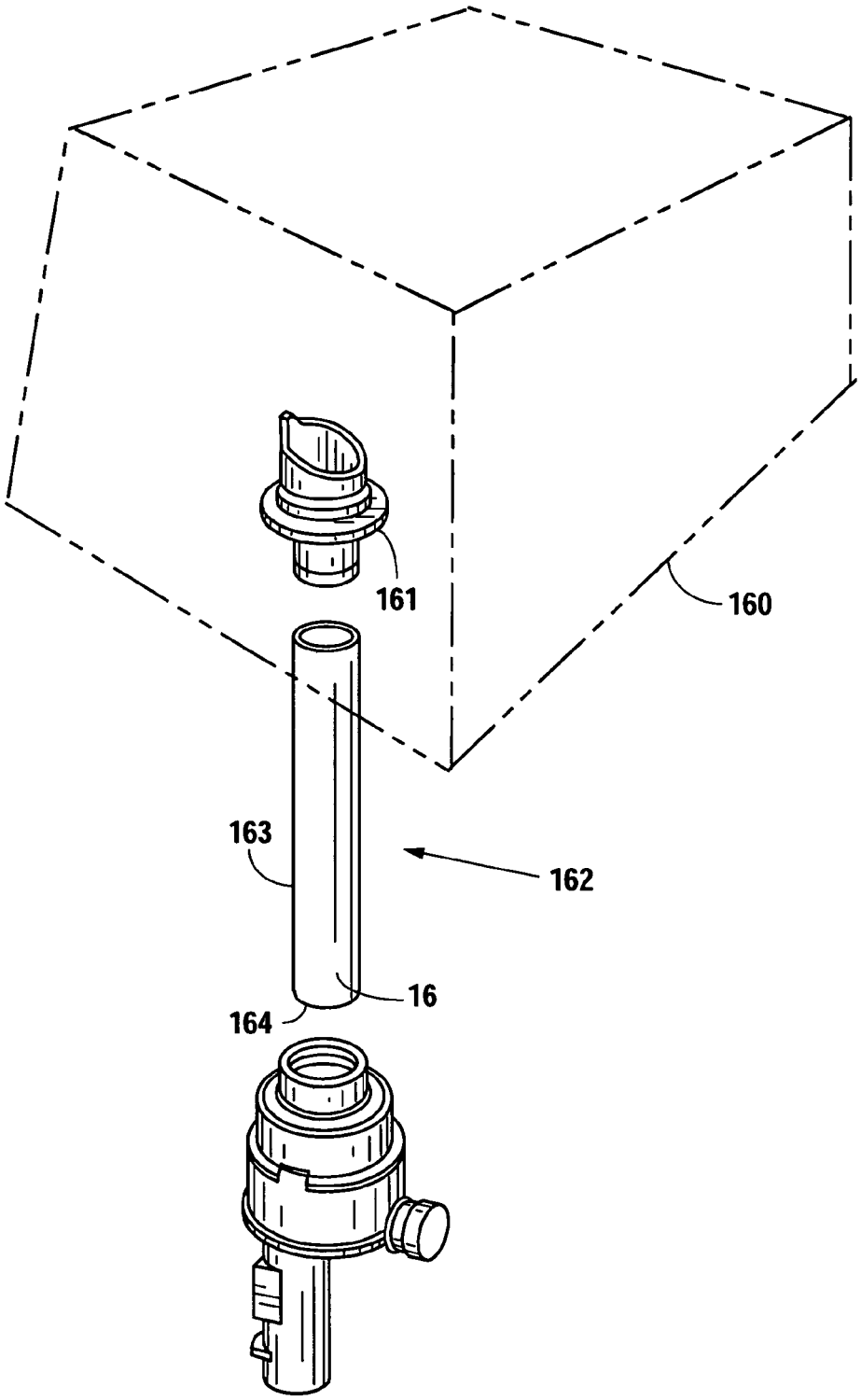
FIG. 4*a* provides a perspective view of a product circuit according to the preferred embodiment.

In a simplest configuration, shown in FIG. 4*a*, the product circuit configuration 102 includes a product package 160, a fitment 161 connected to the product package 160, and a tube 162 connected to the fitment 161, thereby enabling a product disposed within the product package 160 to be evacuated through the tube 162. In this simplest configuration, an outer diameter 163 of the tube 162 is complementary in size to the second inner diameter 148 of the inlet port 154 of the mixer cover 122. As such, an outlet end 164 of the tube 162 may be inserted into the inlet port 154 to deliver the product into the mixing chamber 135 of the mixer assembly 120 when the tube 162 is acted upon by the pumping device 115. In this specific embodiment, the entire product circuit configuration 102 is replaceable, thereby providing the capability to replenish the product as required by loading a new package 160, fitment 161, and tube 162 into the product dispenser 100, and inserting an outlet end 164 of the new tube 162 into the mixer assembly 120.

The method of loading the product circuit configuration 102 into the product dispenser 100 commences with an operator opening the door 113 to access the chamber 112. Next, the operator installs the mixer assembly 120 by placing the diluent inlet port 133 onto the diluent outlet 119, and securing the mixer assembly 120 in place. At this point, the diluent inlet port 133 is in fluid communication with the diluent circuit 103 of the product dispenser 100. The operator then places the product package 160 into the chamber 112, orients the tube 162 through the pumping device 115, and inserts the outlet end 164 of the tube 162 into the inner port 151 of the mixer assembly 120. The operator may then close the door 113 to close out the chamber 112 and to restrain the product circuit configuration 102 components within the chamber 112.

Figure 4B:
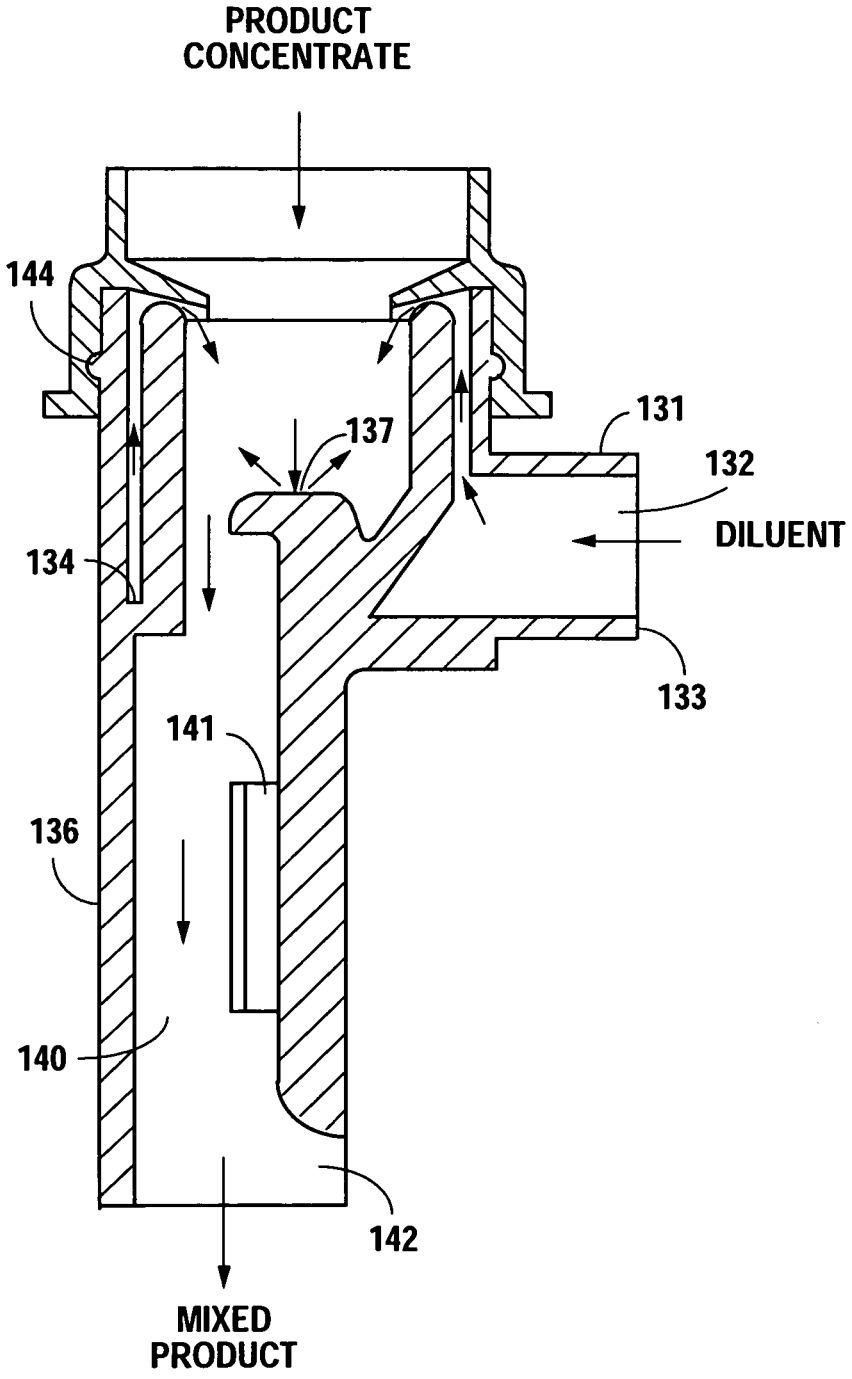
FIG. 4*b* provides a section view of the mixer assembly according to the preferred embodiment.

In operation as illustrated in FIG. 4*b* and responsive to a dispense request by an operator, the controller 108 commences the flow of product and diluent through the product circuit configuration 102 and the diluent circuit 103 of the product dispenser 100 by opening the valve 116 and activating the pumping device 115. The diluent moves from the diluent source, through the diluent line 117, through the valve 116, and through the diluent outlet 119, thereby entering the diluent inlet port 133 of the mixer assembly 120. The diluent moves through the diluent passage 132, into the diluent chamber 125, and through the passes 130 disposed between the protrusions 129 of the inner cylindrical wall 124. The diluent gains velocity as it passes through the passes 130 and is directed downward by the annular shelf 149. The angle 150 of the annular shelf 149 is inherited by the diluent moving through the passes 130. The inherited downward direction forces the diluent entering the mixing chamber 135 to impinge on the deflector 137, thereby forcing increased interaction between the diluent and the product.

Substantially simultaneously, the pumping device 115 removes product from the product package 160. In this particular example, the pumping device 115 is a peristaltic pump that engages the tube 162. The product moves to the outlet end 164 of the tube 162 and is dispensed into the mixing chamber 135 for interaction with the diluent.

Upon the presence of both streams in the mixing chamber 135, the product stream in the mixing chamber 135 is engaged by the diluent entering the mixing chamber 135. In this particular example, the diluent moves along the angle 150 of the annular shelf 149, and into the product stream. The partially mixed product and diluent then moves into the deflector 137 and is redirected, thereby causing increased interaction between the diluent and product concentrate. The mixture then moves from the mixing chamber 135 to the outlet passage 140 and exits the mixer assembly 120 through the outlet port 139. The drain relief 142 at the outlet port 139 forces virtually all of the diluent and product that moves into the mixer assembly 120 to evacuate the mixer assembly 120. Fluids attempting to form a meniscus in the outlet port 139 are forced into an unstable situation at the non-circular outlet port 139, and, therefore, fully drain from the mixer assembly 120.

The mixer assembly 120 may also be cleansed by adjusting the delivery sequence of the product and the diluent as disclosed in U.S. Pat. No. 7,334,706, herein incorporated by reference. Accordingly, diluent may be delivered before the delivery of product to pre-wet the mixer assembly 120, diluent may be delivered for a predetermined interval after the product to rinse the mixer assembly 120, or a combination of both may occur to pre-wet and rinse the mixer assembly 120, thereby promoting the sanitizing of the mixer assembly 120. One of ordinary skill in the art will recognize that the pumping device 115 and the diluent valve 116 may be instructed by the controller 108 to conduct the pre-wet or post-rinse routines.

Figure 5:
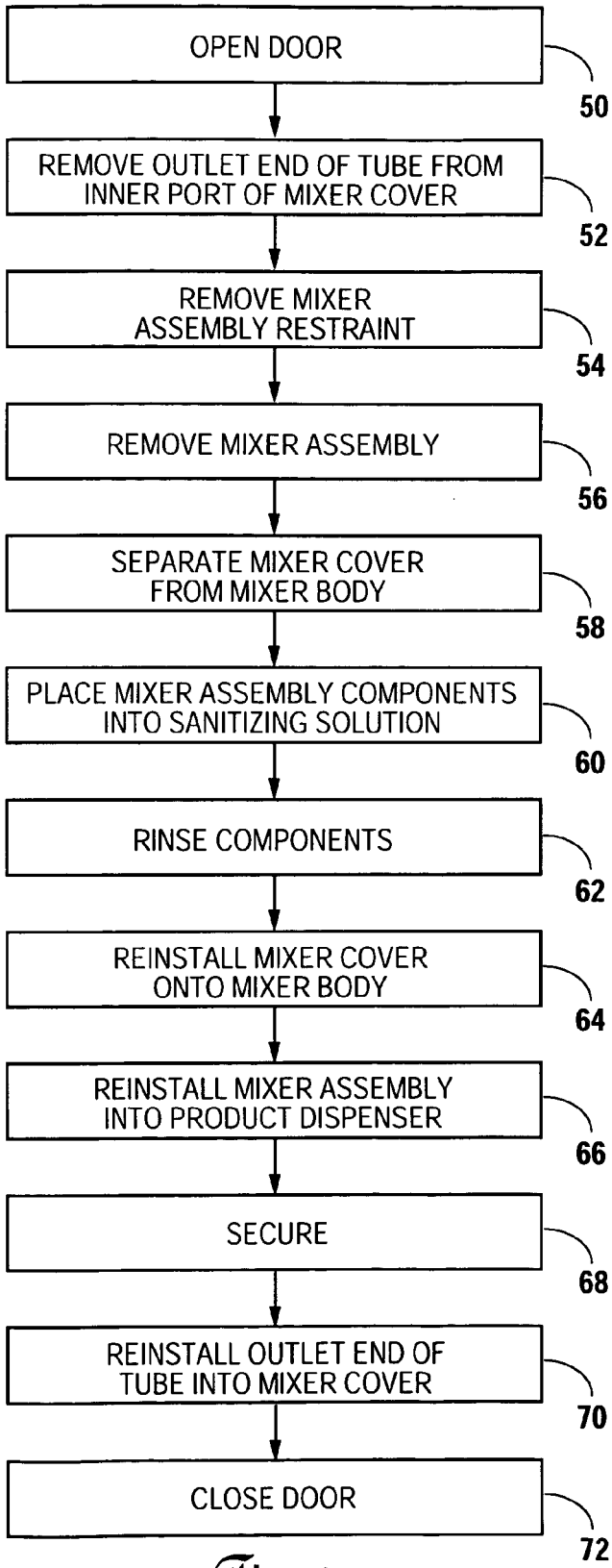
FIG. 5 provides a flowchart illustrating the method steps for sanitizing the mixer assembly according to the preferred embodiment.

Sanitizing of the mixer assembly 120, preferably, is accomplished outside of the product dispenser 100, thereby ensuring that all parts of the mixer assembly 120 are exposed to cleansing agents or dilutions thereof. Illustratively, in this preferred embodiment, the method of sanitizing the mixer assembly 120 follows the method flowchart provided in FIG. 5. The process commences with step 50, wherein an operator opens the door 113 of the product dispenser 100 to access the mixer assembly 120. The operator then removes the outlet end 164 of the hose 162 from the inlet port 154 of the mixer cover 122, step 52, and then disengages the mixer assembly 100 restraint, step 54. At this point, the operator removes the mixer assembly 120 from the product dispenser 100 for cleansing, step 56. Step 58 requires the operator to separate the mixer cover 122 from the mixer body 121 to ensure that all surfaces are exposed to a sanitizing solution. In step 60, the operator places the mixer assembly 120 components into the sanitizing solution. Upon exposure to the sanitizing solution for a predetermined period, the components are rinsed to remove sanitizing solution from the mixer assembly 120, step 62. Step 64 provides for reinstalling the mixer cover 122 onto the mixer body 121, and step 66 provides for reinstalling the mixer assembly 120 into the product dispenser 100. The mixer assembly 120 is secured in the product dispenser 100 in step 68. After securing of the mixer assembly 120, the operator reinserts the outlet end 164 of the tube 162 into inlet port 154 of the mixer cover 122, step 70. The operator then closes the door 113 of the product dispenser 100 for use, step 72.

Figure 6A:
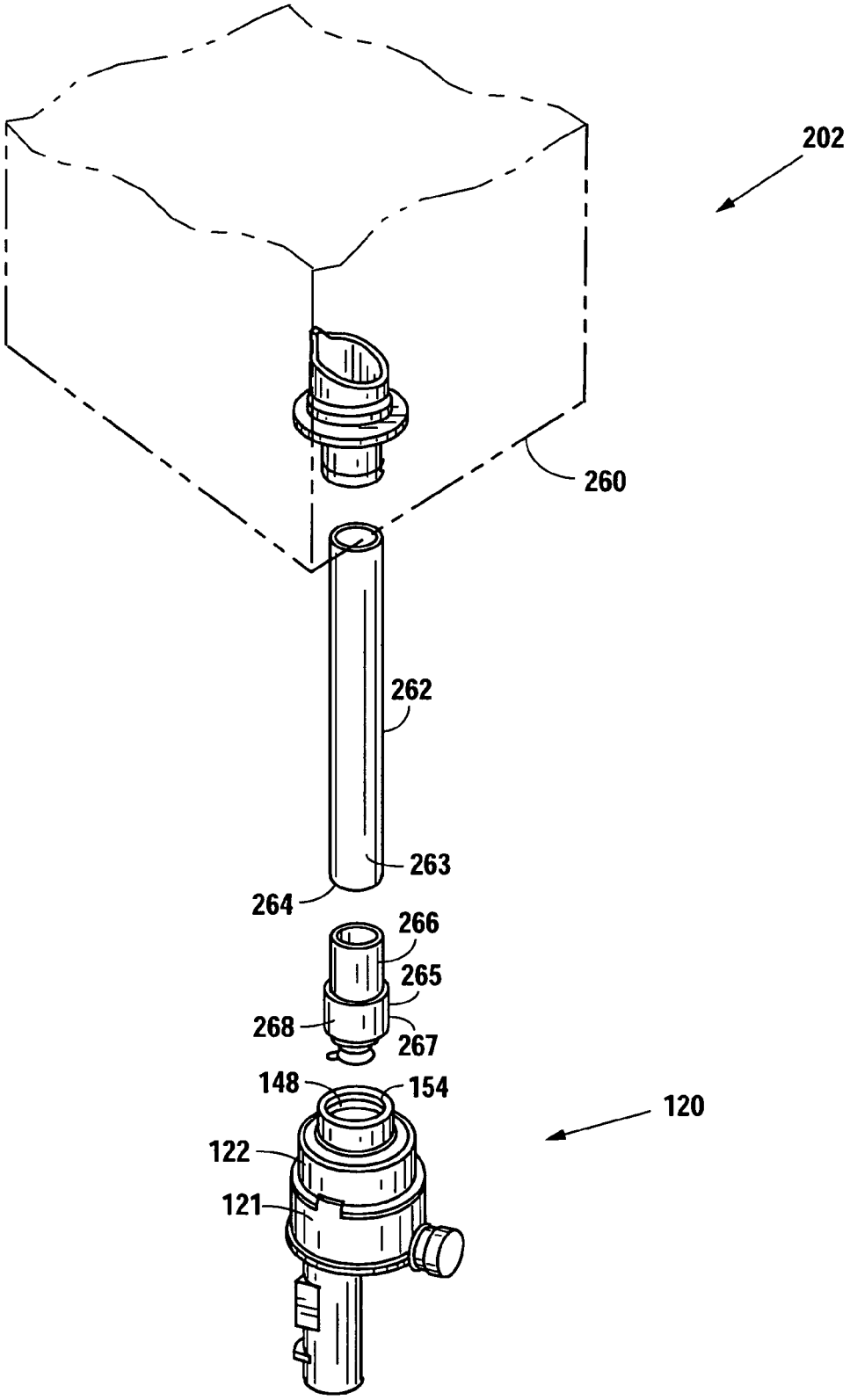
FIG. 6*a* provides a perspective view of a product circuit according to an extension of the preferred embodiment.
Figure 6B:
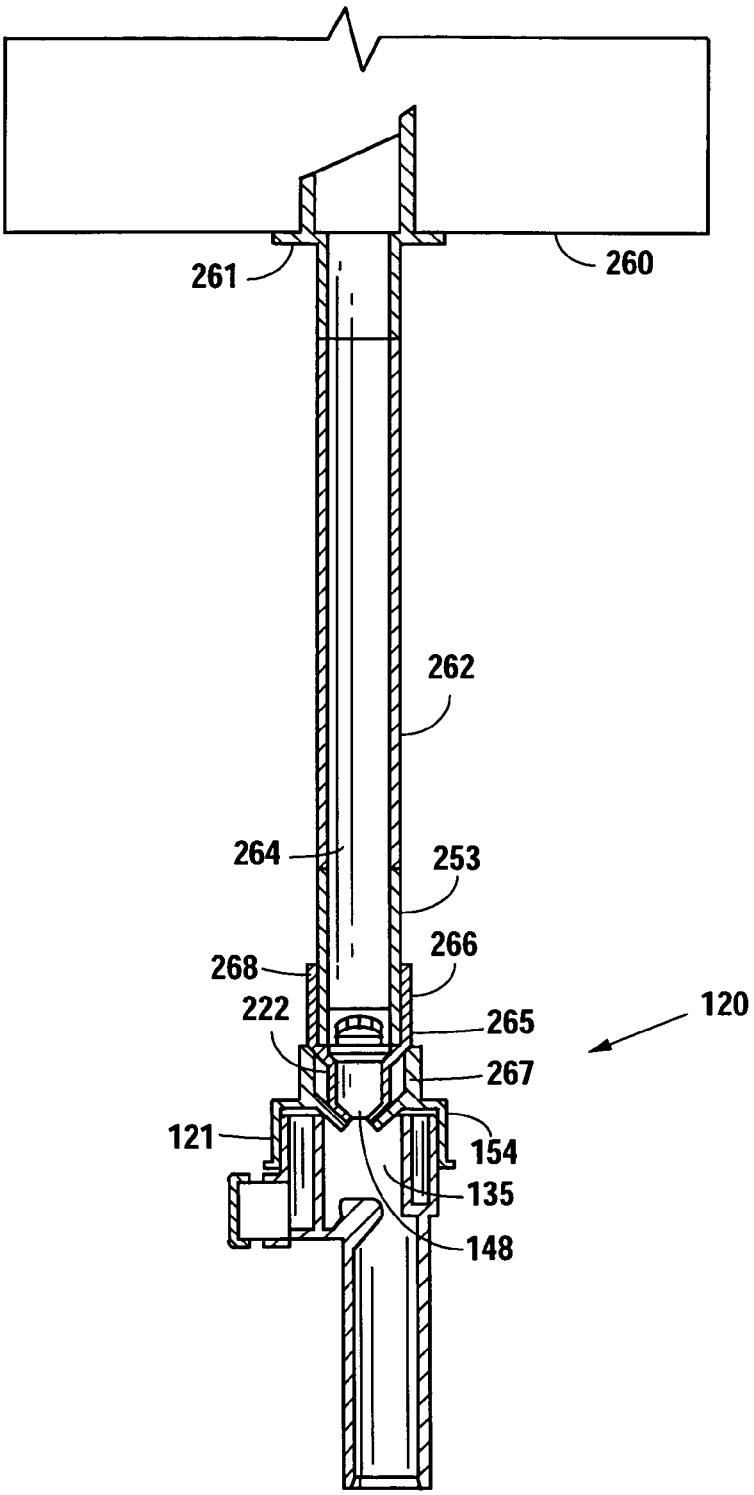
FIG. 6*b* provides a section view of the product circuit according to the extension of the preferred embodiment.

In an alternative embodiment, shown in FIGS. 6*a* and 6*b*, a product circuit configuration 202 includes a self-sealing dispensing valve to control dripping and to provide a barrier between the product and an ambient environment. The self-sealing dispensing valve may be any suitable dispensing valve, as described in U.S. Pat. No. 7,572,113 B2, herein incorporated by reference. In particular, U.S. Pat. No. 7,572, 113 B2 discloses a valve such as that disclosed in U.S. Pat. No. 5,213,236. Such a self-sealing dispensing valve allows liquid to be dispensed during pumping operations without restricting flow because it has a relatively low opening pressure and negligible pressure drop across the valve, and once the pumping ceases, the self-sealing dispensing valve automatically seals, thus providing a relatively sharp cut-off that prevents leaking and dripping without the need for any action by the user.

In this particular example, the product circuit configuration 202 includes the components of the product circuit configuration 102, and further includes a self-sealing dispensing valve 265 to provide a barrier between the product and an ambient environment. As shown in FIGS. 6*a*-6*b*, the self-sealing dispensing valve 265 includes a tube-engaging portion 266 and a downstream section 267, with a self-sealing dispensing valve 265 disposed between the two sections. In this particular example, an outer diameter 268 of the downstream section 267 is complementary in size to a second inner diameter 148 of an inlet port 154 of the mixer cover 122. As such, the downstream section 267 may be placed into the second inner diameter 148 of the mixer cover 122, thereby restraining an outlet end 264 of the tube 262 in place and eliminating splash potential between the self-sealing dispensing valve 265 and the mixer assembly 120. Accordingly, product may move from the product package 260, through the fitment 261, the tube 262, the self-dispensing valve 265, and through the inner port 251, thereby gaining entrance to the mixing chamber 135.

Figure 7:
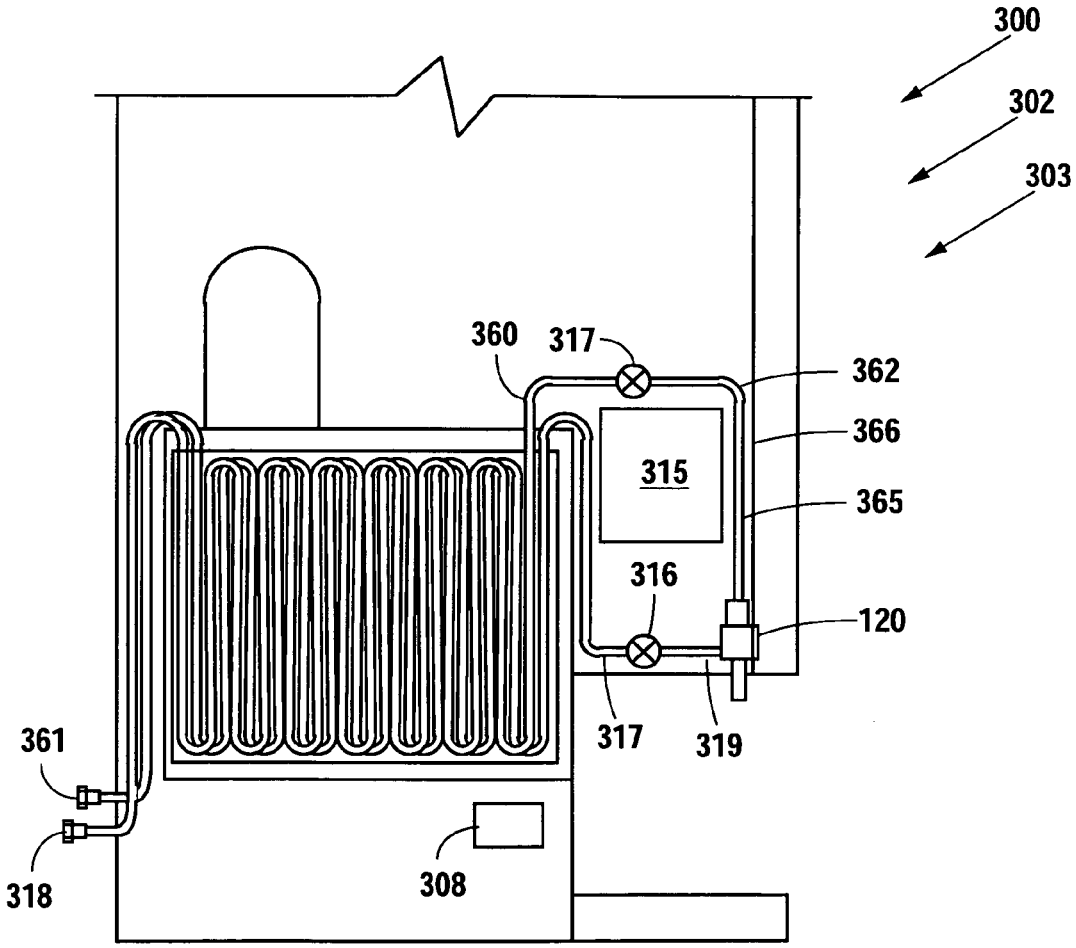
FIG. 7 provides a section view of a product dispenser including an integral product circuit according to the extension of the preferred embodiment.

While this invention has been shown with a replaceable product circuit, one of ordinary skill in the art will recognize that a product circuit permanently disposed within the product dispenser is possible when utilizing a remote product source in similar fashion to the diluent source of the previous embodiments. Illustratively, a beverage syrup circuit 302 may be employed to deliver a chilled product to the mixer assembly 120. As shown in FIG. 7, a product dispenser 300 includes all of the components of the product dispenser 100, except for the replaceable product circuit. In this embodiment, the product circuit 302 is integral to the product dispenser 300, and includes a product line 360 having an inlet 361, and an outlet 362 in communication with an inlet 366 of a tube 365. In this particular example, the tube 365 is engaged by a pumping device 315, as described in the previous embodiment. The product dispenser 300 further includes a diluent line 317 having an inlet 318 and an outlet 319, and a valve 316. Accordingly, a controller 308 is able to control the flows of the diluent and product concentrate by operating the valves 316-317 and instructing the pumping device 315 to engage the tube 365. All other operations of the product dispenser 300 are similar in form and function to the first embodiment.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A mixer assembly, comprising:

a mixer body, comprising:

an inner wall defining a mixing chamber having an inlet and an outlet, wherein the inner wall includes a plurality of protrusions disposed on top of the inner wall, thereby forming a plurality of passes between the plurality of protrusions, further wherein a product enters the mixing chamber through the inlet and exits the mixing chamber through the outlet; and a shell disposed around the inner wall such that the inner wall and the shell form a diluent chamber therebetween that surrounds the mixing chamber, the diluent chamber including an inlet and an outlet communicating with the plurality of passes, wherein a diluent entering the diluent chamber through the inlet fills the diluent chamber and exits the diluent chamber through the outlet, further wherein the diluent flows from the outlet through the plurality of passes and to the mixing chamber for mixing with the product entering the inlet of the mixing chamber, still further wherein the product mixes with the diluent in the mixing chamber and a mixed product moves to the outlet for delivery.

2. The mixer assembly according to claim 1, further comprising a mixer cover coupled to the mixer body, wherein the mixer cover includes an angled shelf that closes out the diluent chamber and extends over the plurality of passes, thereby forming a mixer assembly that forces the diluent to move through the plurality of passes along the angled shelf and into the mixing chamber.

3. The mixer assembly according to claim 2, wherein the angled shelf angles toward the outlet of the mixing chamber.

4. The mixing assembly according to claim 2, wherein the mixer cover further includes an outlet port adaptable to the shell of the mixer body, whereby the outlet port is placed over the shell until the angled shelf contacts the plurality of protrusions and the shell, thereby closing out the diluent chamber.

5. The mixing assembly according to claim 2, wherein the mixer cover further includes an inlet port adaptable to a product package, wherein a product outlet of the product package is coupled to the inlet port, thereby allowing the product to move from the product package into the mixer assembly.

6. The mixer assembly according to claim 5, wherein the coupling of the product package outlet to the inlet port of the mixer cover eliminates exposure to an ambient environment and eliminates errant splashing as the product moves from the product package to the mixer assembly.

7. The mixer assembly according to claim 2, wherein the diluent moving through the plurality of passes moves along the angled shelf and continues toward a center of the mixing chamber.

8. The mixer assembly according to claim 2, wherein the mixer cover is removable for cleansing.

9. The mixer assembly according to claim 2, wherein the diluent passing through the plurality of passes inherits the angle of the angled shelf, thereby engaging the product in the mixing chamber at an angle.

10. The mixer assembly according to claim 2, wherein the diluent flowing through the plurality of passes between the plurality of protrusions and the angled shelf enters into the mixing chamber at an increased velocity.

11. The mixer assembly according to claim 1, further comprising a deflector disposed in the mixing chamber, wherein diluent moving through the plurality of passes is directed to the deflector, further wherein the deflector forces a change in direction of the diluent and the product entering the mixing chamber to increase the interaction between the product and the diluent.

12. The mixer assembly according to claim 1, further comprising a drain relief disposed in the outlet of the mixing chamber, wherein the drain relief forces the mixer body to fully drain.

13. The mixer assembly according to claim 12, wherein the drain relief comprises a slot in the outlet of the mixing chamber that prevents a symmetrical fluid meniscus from forming.

14. The mixer assembly according to claim 1, further comprising a flow director disposed in the outlet of the mixing chamber for streamlining erratic flow delivery of mixed product.

* * * * *